US005364094A

United States Patent [19]

Mustion

[11] Patent Number: 5,364,094

[45] Date of Patent: Nov. 15, 1994

[54] GOLF BALL POSITION MARKING AID

[76] Inventor: Richard P. Mustion, 1287 Calle Ultimo, Oceanside, Calif. 92056

[21] Appl. No.: 77,885

[22] Filed: Jun. 15, 1993

[51] Int. Cl.[5] ..... A63B 57/00

[52] U.S. Cl. ..... 273/32 A; 224/918; 224/183

[58] Field of Search ..... 273/32 A; 224/918, 183, 224/268, 269

[56] References Cited

U.S. PATENT DOCUMENTS

| | | | |
|---|---|---|---|
| 2,178,872 | 11/1939 | Engstrom | 273/162 D |
| 3,136,547 | 6/1964 | Schaper | 273/32 A |
| 3,139,690 | 7/1964 | Hait | 273/32 A |
| 3,208,123 | 9/1965 | Koos | 273/32 A X |
| 3,233,802 | 2/1966 | Ludwick | 273/32 A X |
| 3,744,542 | 7/1973 | Stephens et al. | 273/32 A |
| 4,130,950 | 12/1978 | Bazzle et al. | 273/32 A X |

FOREIGN PATENT DOCUMENTS

| | | | |
|---|---|---|---|
| 1369506 | 10/1974 | United Kingdom | 273/32 A |

*Primary Examiner*—George J. Marlo
*Attorney, Agent, or Firm*—Harness, Dickey & Pierce

[57] ABSTRACT

A ball marking device adaptable to be worn on the outer clothing of a golfer for providing ready access to a ball marker. The ball marking device includes a metal button having a diameter of approximately 1-½". Attached to a back surface of the metal button is a pin clasp for securing the ball marking device to the clothing of the golfer. On a front surface of the metal button is a ½" diameter round rubber coated magnet secured to the metal button by glue. A ¾" stainless steel disc is magnetically attached to the magnet such that it is secured to the button. When the golfer desires to mark his ball on a putting green, he merely disengages the marker disc from the magnet and places it at the desirable location. Once the golfer no longer wishes to mark his ball with the ball marking disc, he merely returns it to the magnet until its next use.

9 Claims, 1 Drawing Sheet

GOLF BALL POSITION MARKING AID

BACKGROUND OF THE INVENTION

1. Field Of The Invention

This invention relates generally to a golf ball marker and, more particularly, to a golf ball marker magnetically attached to a pinned button worn on the golfer's clothing.

2. Discussion Of The Related Art

The game of golf is a well known and popular sport. Typically, up to four golfers play a "round" of golf together. During a round of golf, the golfers generally take turns hitting their respective golf balls towards the hole or "pin" in an organized fashion. Golf etiquette calls for the player farthest from the pin to be the next player to hit his golf ball. When all of the players are on the "green" area surrounding the pin, the players continue the game by "putting" their respective golf ball towards, and hopefully into, the hole. Once again, the position of the golf balls dictates who's turn it is such that the player farthest from the pin is the first to putt his golf ball. With up to three other golf balls lying on the green in their respective positions closer to the hole, it is likely that one or more of these balls will be in the "line" of the player putting such that the ball may block the hole from the ball of the putting player. Additionally, the closer players' balls may lie beyond the hole from the putting player, but still may be in jeopardy of being hit. The game allows for penalty strokes to be assessed to the player whose ball is hit by another player's ball. Also, a player may wish to pick up his ball to wipe off dirt or other matter which may impede the ball from rolling in a smooth fashion. The occasion therefore arises when players want to or are obligated to "mark" their ball with some type of marking device which lies flat on the green, and thus, is not an obstacle to the player who is putting.

Golf ball markers come in a variety of styles. A ball marker is, however, typically a round flat object of an inconspicuous nature. Known golf ball markers may be of either a plastic or metal material. For the most part, prior art golf ball markers are carried in the pocket of the golfer, typically intermingled with other items such as golf tees, change, etc. until the need arises for its use. The golfer must therefore retrieve the ball marker from his pocket when it is needed. This procedure may provide a certain degree of irritation to the golfer in that the golfer may have to vigorously search for the ball marker within the pocket. Because putting is typically the part of the golf game requiring the most finesse, a limited amount of frustration, such as could be generated by having to search for a ball marker within the golfer's pocket, may cause this frustration to be carried over to the actual act of putting a short time later. Further, the act of searching for a ball marker in a pocket may cause a golfer to actually damage or rip the pocket itself. Consequently, the need to carry a ball marker in a golfer's pocket during a round of golf may have a detrimental effect on the game itself.

What is needed is a golf ball marker which is readily accessible to the golfer during a round of golf. It is therefore an object of the present invention to provide such a golf ball marker.

SUMMARY OF THE INVENTION

This invention discloses a golf ball marker carrier and associated golf ball marker. The carrier is a round metal button that includes a pin clasp secured to its back surface. A round, rubber coated magnet is glued to a front surface of the button. A magnetic ball marker in the shape of a disc is attached to the magnet.

When playing a round of golf, a golfer will pin the button to a convenient location on his clothing. In this location, the ball marker is continuously and readily available for use. When the golfer enters the putting green and recognizes a need to mark his ball, the golfer need only slide the ball marker off of the magnet and place it at the appropriate location on the green while at the same time retrieving his ball. Once it is the golfer's turn to putt, he merely retrieves the ball marker and reattaches it to the magnet where it is securely held in place until the next time it is needed.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments concerning a ball marker and associated ball marker carrier is merely exemplary in nature and is in no way intended to limit the invention or its application or uses.

Figure 1:
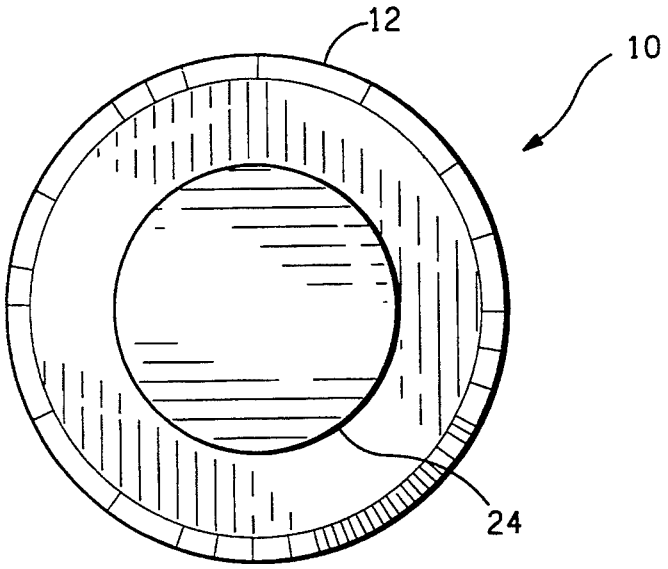
FIG. 1 is a front view of a ball marker carrier and associated ball marker.
Figure 2:
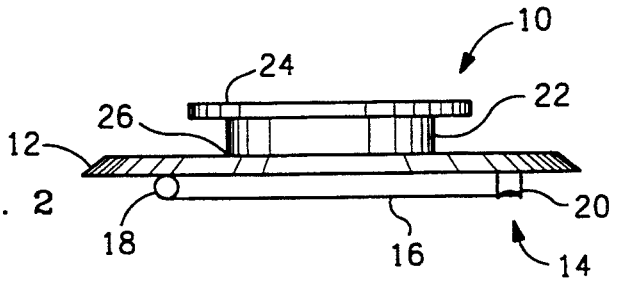
FIG. 2 is a side view of the ball marker carrier and the ball marker of FIG. 1.
Figure 3:
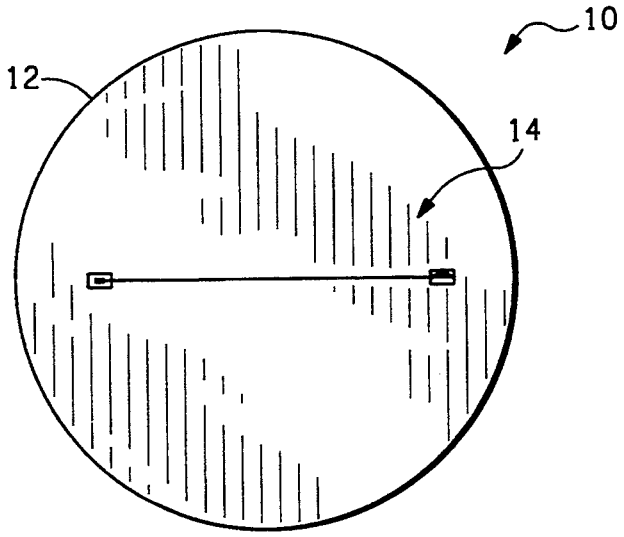
FIG. 3 is a back view of the ball marker carrier of FIG. 1.

FIGS. 1, 2 and 3 show a front view, side view and back view, respectively, of a golf ball marker and carrying device 10. In accordance with the teachings of the present invention, the golf ball marker and carrying device 10 includes a round metal button or disc 12. In a preferred embodiment, the metal button or disc 12 is approximately 1 ½" in diameter and is made of aluminum. A pin clasp assembly 14 is secured to a back surface of the metal button or disc 12. The pin clasp assembly 14 is of a conventional nature in that it includes an elongated pin 16 rigidly secured at one end to a spring mechanism 18 and releasably secured at the other end to a hook member 20. The pin 16 can be continually released from and secured to the hook member 20 against the bias of the spring mechanism 18. A button and associated pin as just described is well known. Such buttons are typically pinned to clothing such that a message written on a front surface of the button can be conveyed.

Secured to a front surface of the metal button 12 is a magnet 22. In a preferred embodiment, the rubber coated magnet 22. The rubber coated magnet 22 is rigidly secured to the metal button 12 by any applicable means such as glue 26. Magnetically secured to the magnet 22 is a flat, round ball marker 24. In a preferred embodiment the rubber coated magnet 22 is approximately ½" in diameter and the ball marker 24 is a 430 polished magnetic stainless steel disc having a diameter of approximately ¾" and a thickness of approximately 1/16". It will be appreciated, however, that the ball marker 24 can be of any applicable ferromagnetic material so that it will be magnetically attracted and secured to the magnet 22. A plastic member embedded with iron shavings may provide an attractive alternative.

When a golfer desires to use the golf ball marker and carrying device 10, he unclasps the pin 16 from the hook member 20 and pierces the pin 16 through a desirable portion of his clothing such that the pin 16 can be re-engaged to the hook member 20 and the ball marker and carrying device 10 will be secured to the golfer's clothing. The operation of the pin clasp assembly 14 is well understood in the art. When the golfer enters the putting green when playing a round of golf, and recognizes a need to mark his golf ball, the ball marker 24 is readily accessible to the golfer in that it is carried on the exterior of the golfer's clothing and is easily disengaged from the magnet 22. When it is the golfer's turn to putt, and the golfer replaces the ball marker 24 with the golf ball, the golfer can readily secure the marker 24 to the magnet 22 by merely touching the marker 24 to the magnet 22.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed:

1. A golf ball marking device securable a user's clothing comprising:

a button, said button being disc-shaped having front and back sides, and having a first diameter;

a means for securing the button to said user's clothing, the means for securing being attached to the back side of the button;

a disc-shaped magnet having front and back sides, permanently secured at its back side to said front side of the button, said magnet having a second diameter which is smaller than said first diameter; and a ferromagnetic disc-shape ball marker magnetically and removably attached to said front side of the magnet, said ball marker having a third diameter which is larger than said second diameter but smaller than said first diameter, whereby the ball marker is easily removable from the magnet when used to mark a golf ball and is easily reattachable to the magnet when the ball marker is not being used.

2. The golf ball marking device according to claim 1 wherein the means for securing the button to the user's clothing is a pin clasp assembly secured to the back surface of the button, the pin clasp assembly including a pin and hook member such that the pin is operable to pierce the user's clothing and be secured to the hook member in order to secure the button to the pierced clothing.

3. The golf ball marking device according to claim 1 wherein the button has a diameter of approximately $1\frac{1}{2}$ inches.

4. The golf ball marking device according to claim 1 wherein the ball marker is a stainless steel disc that can be magnetically attached to said magnet.

5. The golf ball marking device according to claim 4 wherein the ball marker has a diameter of approximately $\frac{1}{2}$ of an inch.

6. The golf ball marking device according to claim 1 wherein the magnet has a rubber coated layer which is thick enough to completely enclose the magnet but sufficiently thin such that the magnet retains it's ability to attract and support the ball marker.

7. The golf ball marking device according to claim 6 wherein the rubber coated magnet has a flat round shape with a diameter of approximately $\frac{1}{2}$ of an inch.

8. The golf ball marking device according to claim 1 wherein the magnet is secured to the button using a glue, the glue being applied between the contacting surfaces of the magnet and the button.

9. A golf ball marking device securable a user's clothing comprising:

a button, said button being disc-shaped having front and back sides, and having a first diameter;

a means for securing the button to said user's clothing, the means for securing being attached to the back side of the button;

a disc-shaped magnet having front and back sides and having an exterior coating of rubber permanently secured at its back side to said front side of the button, said magnet having a second diameter which is smaller than said first diameter; and a ferromagnetic disc-shape ball marker magnetically and removably attached to said front side of the magnet, said ball marker having a third diameter which is larger than said second diameter but smaller than said first diameter, whereby the ball marker is easily removable from the magnet when used to mark a golf ball and is easily reattachable to the magnet when the ball marker is not being used.

* * * * *